United States Patent [19]

Zang

[11] 4,328,928

[45] May 11, 1982

[54] DEVICE FOR HOLDING A TUBULAR SUPPORT SPOOLING TEXTILE MATERIALS

[75] Inventor: Robert Zang, Roanne, France

[73] Assignee: ASA S.A., Roanne, France

[21] Appl. No.: 166,324

[22] Filed: Jul. 7, 1980

[30] Foreign Application Priority Data

Jul. 10, 1979 [FR] France ..... 79 18407

[51] Int. Cl.[3] ..... B65H 54/42; B65H 49/26

[52] U.S. Cl. ..... 242/18 DD; 242/68.4; 242/129.51

[58] Field of Search ..... 242/18 DD, 129.51, 65, 242/66, 68.4

[56] References Cited

U.S. PATENT DOCUMENTS 2,757,874 8/1956 Marcellus ..... 242/129.51 X
3,131,885 5/1964 Furst et al. ..... 242/129.51
3,433,433 3/1969 Pospisil et al. ..... 242/129.51
3,941,320 3/1976 Strunk ..... 242/129.51 X
4,126,279 11/1978 Munnekehoff ..... 242/18 DD

FOREIGN PATENT DOCUMENTS 851867 10/1952 Fed. Rep. of Germany .

*Primary Examiner*—Stanley N. Gilreath
*Attorney, Agent, or Firm*—Arnold, White & Durkee

[57] ABSTRACT

A device for holding a tubular support on which yarn is to be spooled has a pivotable yoke comprising two arms each with a plate to engage the support. One arm is laterally movable and the plate on that arm is in two parts, an external part to engage the support, and an internal part pivoted on the arm. A connection allowing only axial relative movement is between the parts. The arm has a braking device to engage the external part when such axial movement is brought about by pressing on the arm.

4 Claims, 3 Drawing Figures

DEVICE FOR HOLDING A TUBULAR SUPPORT SPOOLING TEXTILE MATERIALS

The present invention relates to a device for holding a tubular support for spooling a yarn by rotating the support by means of a tangential drive cylinder.

This spooling technique has been known for a very long time and the devices used for carrying it out essentially comprise a pivoting yoke having two parallel arms, the ends of the said arms being provided with gripping plates intended to engage the ends of the tubular support, these plates being mounted for free rotation on axles carred by the arms.

In order to facilitate the positioning and the removal of the support between the gripping plates, one of the two arms forming the yoke can be displaced laterally, while additional means are usually provided for ensuring uniform contact of the winding against the drive cylinder as spooling proceeds.

One of the problems which arises with this type of device is in connection with braking of the winding formed, in particular when it is desired to remove a full tube and position an empty tube. In fact, due to present day high speed operation, when the yoke is moved away from the drive cylinder the spool formed continues to rotate freely for a period which can be rather long.

To solve this problem various devices for braking the winding have hitherto been proposed.

Thus, French Pat. No. 2,367,011 described a spooling device in which that arm which can be displaced laterally consists of two articulated levers, the end lever carrying a brake shoe so that, when it is displaced, it bears on the periphery of the plate holding the winding. However, this construction is complex due to the fact that it comprises two levers and consequently two articulation axles.

According to the present invention there is provided a device for holding a tubular support on which yarn is spooled and which can be rotated by tangential contact with a drive cylinder, the device including a pivotable yoke having two arms carrying freely rotatable plates to engage the tubular support, one of the arms being laterally movable to allow positioning and removal of tubular supports, wherein the rotatable plate on the movable arm has a radially external part to centre and engage the tubular support and a radially internal part rotatably mounted on the arm, the parts being connected by an element allowing relative axial movement but not relative radial movement between the parts, and including braking means operable to brake the rotatable plate on the movable arm upon such relative axial movement of the parts.

Such a construction makes it possible to ensure effective and rapid braking of the winding formed, whilst being of simple design and hence economical to manufacture and to maintain.

Preferably, the connecting element between the parts is a steel diaphragm. Preferably also, axial displacement of the internal part relative to the external part is achieved by applying pressure on the movable arm, and said arm carries a cap provided with friction surfaces which, upon such displacement, bears on a fixed surface on the external part.

In order to improve the gripping of the tubular support by the external part, the latter can have claws or spikes, which penetrate inside the said support. During braking, the force exerted by the operator is communicated to the external part, and this increases the contact pressure between this part and the tubular support and prevents the formed spool from sliding.

The invention and the advantages which it provides will be understood more clearly from the following description which is given by way of example with reference to the attached drawings in which.

Figure 1:
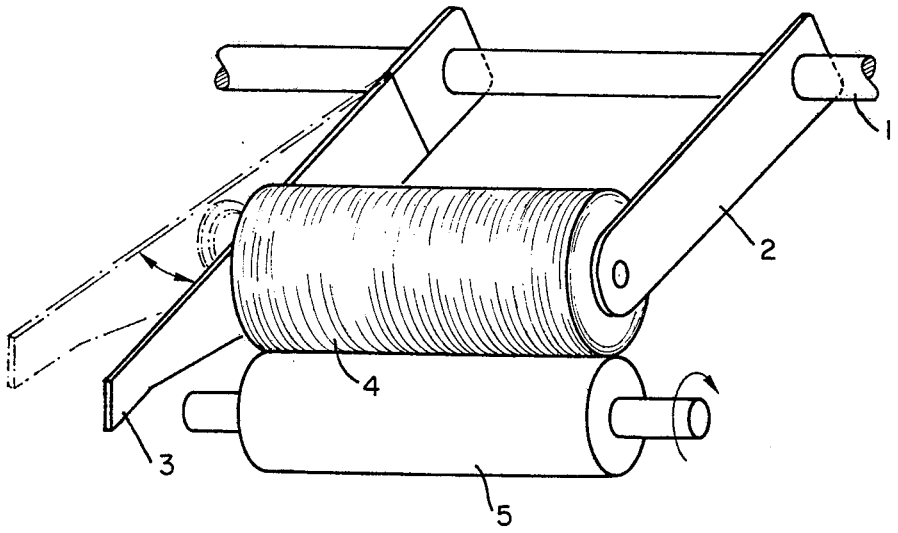
FIG. 1 is a general perspective view of a device according to the invention.

As shown in FIG. 1, the spooling device according to the invention essentially consists of a yoke which pivots about a fixed axle 1 during the formation of the winding; this yoke essentially consists of two parallel arms 2, 3 carrying plates which are mounted for free rotation on these arms and are intended to hold the winding 4 formed.

For the formation of the winding 4, rotation is caused by means of a drive cylinder 5 with which the winding is in tangential contact.

Furthermore, one of the arms (in the present case the arm 3) can be displaced laterally (position shown in dot-and-dash lines in FIG. 1) in order to facilitate the positioning of an empty support and the removal of the winding formed. Furthermore, braking means, which are not shown in FIG. 1, make it possible to stop the rotation of the winding 4 formed, when the yoke is moved away from the drive cylinder 5, for example during the replacement of the winding by an empty support tube.

Figure 2:
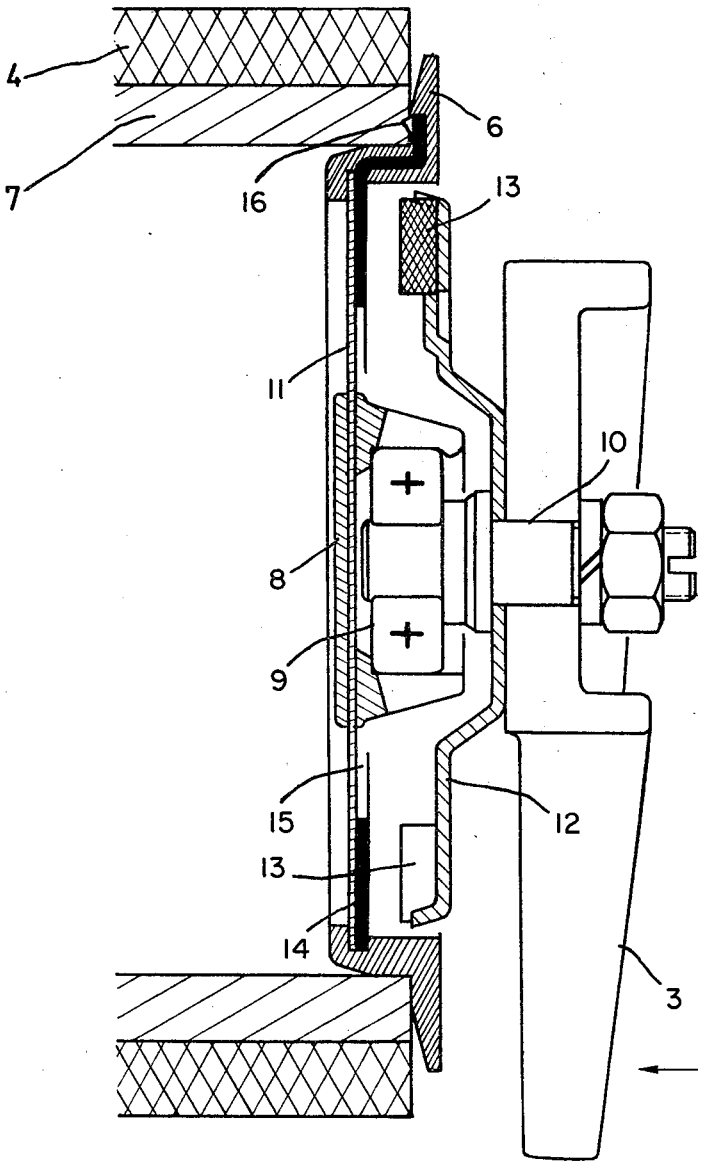
FIG. 2 is a section showing, in detail, the construction of a plate for holding the tubular support onto which the yarn is wound.

As shown in greater detail in FIG. 2, the plate mounted on the movable arm 3 of the yoke is produced in two parts, one being the external part 6, which forms the centering device and holding element for the tubular support 7 around which the winding 4 of the yarn is formed, and the other being the internal part 8, which is mounted for free rotation, for example by means of a bearing 9, on a fixed axle 10 carried by the arm 3.

According to the invention, these two parts 6 and 8 are joined to one another by an element permitting the axial displacement of the internal part 8 relative to the external part 6, under the action of a thrust exerted on the movable arm 3, this element ensuring, however, the radial rigidity of the two parts 6 and 8 relative to one another.

In the embodiment illustrated by FIG. 2, the joining element between the two parts 6 and 8 consists of a steel diaphragm 11. Advantageously, the internal part 8 and the external part 6 of the plate are made of plastic and obtained by moulding.

Furthermore, the arm 3 is associated with braking means which, during the axial displacement of the central part 8, in the present case under the action of a thrust exerted on the arm 3, come into contact with the external part 6 forming the centering device.

In the embodiment illustrated by FIG. 2, these braking elements consist of a steel cap 12 which is mounted on the axle 10 and which carries friction surfaces, for example Ferodo shoes 13, on its periphery. The action of these braking surfaces 13 is achieved in the present case by providing a rigid steel plate 14 which is embedded in the external part 6 and is essentially in the form of a ring, it being possible for the internal element 8 to be displaced inside the opening 15 in this ring.

In the embodiment illustrated by FIG. 2, the ring 14 possesses claws 16 which, when the support tube 7 is positioned, penetrate inside the latter and prevent it from rotating.

Figure 3:
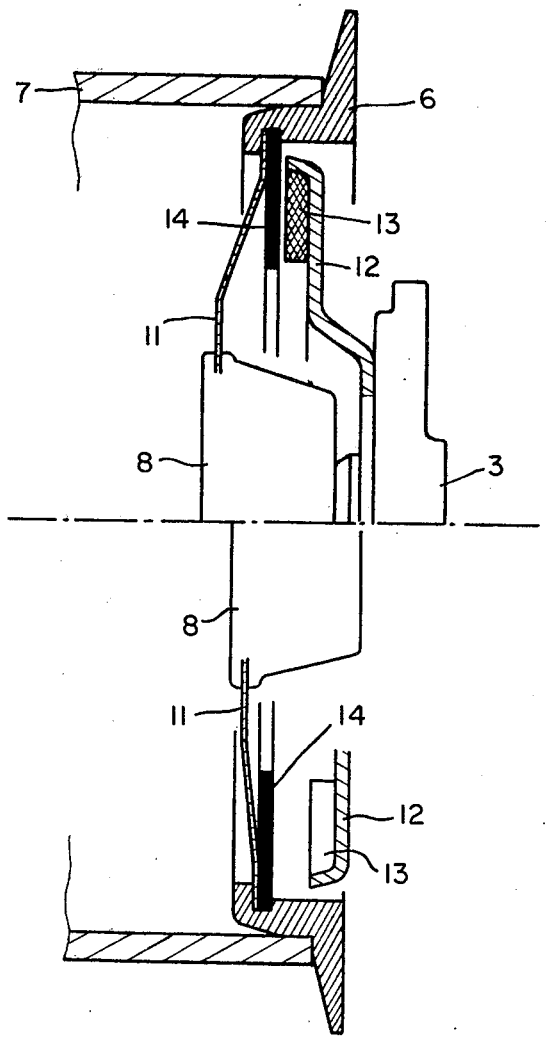
FIG. 3 is a simplified section showing in the lower half-view the position of the elements forming the plate during the actual spooling and in the upper half-view the position of those elements during braking of the tubular support.

The operation of a device of this type is illustrated in greater detail in FIG. 3, which figure only shows the main members in part, for the purpose of clarity, the lower half-view showing the device during normal spooling, that is to say corresponding to the position shown in FIG. 2, and the upper half-view showing the manner in which the winding is braked.

In normal operation (FIG. 2 and lower half-view of FIG. 3), the tube 7 supporting the winding is held in a conventional manner by means of the plate according to the invention, the holding and the rigidity of the internal part 8 and of the external part 6 of the plates being ensured by means of the steel diaphragm 11 which is deformable in the axial direction but rigid in the radial direction.

In this case, brake shoes 13 are held away from the external part 6 forming the centering device, and the tubular support 7 around which the yarn is wound can be caused to rotate about the fixed axle 10, carried by the arms 3, by virtue of the presence of the bearing 9.

When it is desired to replace a formed winding by an empty support, in a known manner, the take-up fork is tilted in order to bring it into the storage position.

By virtue of the device according to the invention, it is thus possible to brake the rotation of the winding very rapidly.

To do this, as shown in the upper half-view of FIG. 3, it suffices to bear on the movable arm 3, and this causes the displacement of all the pieces rigidly joined to this arm, namely the axial displacement of the axle 10, of the bearing 9 and of the central element 8 mounted on the said bearing 9.

The central part 8 can move forward by virtue of the flexible join, in the axial direction, provided by means of the steel diaphragm 11, whilst, on the other hand, the external part 6 remains fixed because it is locked by the tube 7 in the axial direction.

Subsequently, the Ferodo shoes 13 carried by the cap 12 move closer to the external part and, in the present embodiment, to the steel ring 14 integral with this external part 6. The shoes 13 thus bear on the surface of this ring 14 and cause the rotation of the winding to stop.

Once this rotation has stopped, it suffices to relax the pressure on the arm 3 and to move it away in order to position the empty support tube.

A device of this type is of particularly simple design and makes it possible to ensure rapid and effective braking of the winding formed during a storage operation.

It is quite obvious that the invention is not limited to the illustrative embodiment described above, but that it also covers all the variants thereof which are constructed in the same spirit. Thus, for example, it would be possible to achieve braking not by using shoes which act on a ring integral with the external part of the plate, but by acting, for example, directly on the lateral surface of the said external part.

Likewise, the join between the internal part and the external part of the plate could be produced by any means other than a steel membrane, which is deformable in the axial direction but rigid in the vertical direction, for example by means of a plastic diaphragm.

In this case, the external and internal parts and the diaphragm of the plate are made of the same plastic and thus form a single piece made in one unit.

I claim:

1. A device for holding a tubular support on which yarn is spooled and which can be rotated by tangential contact with a drive cylinder, such device comprising in combination a pivotable yoke having first and second arms, respective first and second plates freely rotatably mounted on said arms to engage the tubular support, said first arm being laterally movable to allow positioning and removal of tubular supports, said first plate comprising a radially external part to centre and engage the tubular support, a radially internal part rotatably mounted on said first arm and a connecting element connecting said parts and allowing relative axial movement but not relative radial movement between said parts, and said device further comprising braking means operable to brake said first plate upon such relative axial movement between said parts.

2. A device as claimed in claim 1, wherein said connecting element between said parts is a steel diaphragm.

3. A device as claimed in claim 1 wherein said braking means includes, on said first arm, a cap provided with a friction surface engageable, upon such relative axial movement, on a fixed surface on said external part.

4. A device as claimed in claim 1 and further comprising spikes on said external part positioned to engage the tubular support.

* * * * *